United States Patent [19]

Warren et al.

[11] 4,334,654

[45] Jun. 15, 1982

[54] APPARATUS AND METHOD FOR CONTROLLING THE TENSION ON A YARN BUNDLE WITHDRAWN FROM A MASS OF COMPACTED YARN

[75] Inventors: Elbert K. Warren, Candler; William D. Porter, Asheville, both of N.C.

[73] Assignee: Akzona, Incorporated, Asheville, N.C.

[21] Appl. No.: 149,546

[22] Filed: May 13, 1980

[51] Int. Cl.[3] ..... B65H 59/10

[52] U.S. Cl. ..... 242/147 R; 28/255; 226/1; 226/118; 226/195; 242/153

[58] Field of Search ..... 242/147 R, 45, 153, 242/154; 226/118, 119, 195, 196, 1; 28/221, 247, 248, 250, 251, 262, 255, 263

[56] References Cited

U.S. PATENT DOCUMENTS

| | | | |
|---|---|---|---|
| 1,467,443 | 9/1923 | Merritt | 242/154 |
| 1,596,095 | 8/1926 | Gehman | 242/154 |
| 1,997,709 | 4/1935 | Williams | 242/154 |
| 3,003,716 | 10/1961 | Davis et al. | 242/154 |
| 3,958,734 | 5/1976 | Fink et al. | 226/119 X |
| 4,019,229 | 4/1977 | Chastang | 242/153 X |

*Primary Examiner*—Stanley N. Gilreath

*Attorney, Agent, or Firm*—Craig & Antonelli

[57] ABSTRACT

An apparatus for controlling the tension on yarn withdrawn from a mass of compacted yarn within a confined space has a yarn guide element with a tubular wall portion defining a confined space for guiding and for accumulating a compacted mass of yarn, an inlet opening for entry of the compacted yarn mass into one end of the confined space and an outlet opening for allowing withdrawal of the yarn as a yarn bundle from the confined space. The outlet opening is an elongated slot that is provided in the wall portion of the yarn guide element and that applies tension to the yarn bundle withdrawn from the confined space. The slot has a preselected configuration so that the slot will vary the tension applied to the yarn bundle as the yarn mass moves from one end of the confined space to the other end.

31 Claims, 7 Drawing Figures

APPARATUS AND METHOD FOR CONTROLLING THE TENSION ON A YARN BUNDLE WITHDRAWN FROM A MASS OF COMPACTED YARN

This invention relates to an apparatus and method for controlling the tension on a yarn withdrawn as a yarn bundle from a mass of compacted yarn within a confined space and for maintaining an end portion of the compacted yarn mass within the confined space.

In the production of textured yarns from synthetic polymeric materials with a pneumatic bulking apparatus, a compacted mass of yarn or yarn plug is formed within a confined space. After the yarn mass accumulates within the confined space and after the yarn is heat-set, the yarn is removed from the confined space and is taken off in the form of a yarn bundle. U.S. Pat. Nos. 3,983,610 and 4,095,317 are directed, respectively, to a pneumatic apparatus and process for effecting the production of textured yarns within a confined space.

It has been proposed in accordance with U.S. Pat. No. 3,958,734 to provide a method and apparatus for sensing the position of the compacted yarn mass within the confined space and for generating signals to control the speed of withdrawing or taking-up the yarn bundle from the compacted yarn mass and to control the inventory of the yarn mass within the confined space. In order to effect these controls, it is necessary to provide means for sensing the position of the yarn mass within the confined space and for regulating the speed of the take-up unit that withdraws the yarn from the confined space based on the sensed position of the yarn mass.

It will be recognized that, heretofore, there have been many devices for regulating the tension applied to a yarn during yarn winding or yarn handling operations, e.g. U.S. Pat. Nos. 143,268; 988,444; 2,423,211 and 2,462,043. Of these patents, that to Vanselow (U.S. Pat. No. 2,423,211) is of interest in that this patent discloses a knitting aid device that has a finger sleeve for receiving a spiral turn of yarn and a spring-operated means for applying tension to the yarn. This device is worn on the index finger of the operator and requires a spring operated plunger for applying tension to the yarn.

It is an object of the present invention to provide an apparatus and method for varying the tension on a yarn bundle being withdrawn from a compacted yarn mass introduced into a confined space with a variable input so that the yarn bundle can be withdrawn from the yarn mass by a constant speed take-up device.

It is a further object of the present invention to provide an apparatus and method that also control the inventory of the compacted yarn mass within the confined space without requiring means for sensing the position of the compacted yarn mass within the confined space or means for controlling the withdrawal of the yarn based on this sensed position.

Advantageously, this invention contemplates an apparatus for controlling the tension on yarn withdrawn from a mass of compacted yarn within a confined space which comprises a yarn guide means having a tubular wall portion defining a confined space for guiding and for accumulating a compacted mass of yarn, an inlet opening for entry of the compacted mass of yarn into one end of the confined space, and an outlet opening for allowing withdrawal of the yarn in the form of a yarn bundle from the confined space, the outlet opening being an elongated slot provided in the tubular wall portion of the yarn guide means. This slot has such a preselected configuration that the slot acts as a means for varying the tension applied to the yarn as the yarn mass moves from one end of the confined space to the other end. More particularly, the yarn guide means of the present invention is a tubular element or member that has a tubular, preferably cylindrical wall defining the confined space and that has a slot in the cylindrical wall that extends along the length of the confined space, preferably from one end to a point adjacent to the other end.

In one embodiment of the apparatus, the slot is arranged in the cylindrical wall to extend parallel to the longitudinal axis of the tubular element and has a width that increases continuously from one end to the other end in order to decrease the amount of tension applied to the yarn along the length of the slot.

In another embodiment of the invention, the slot in the cylindrical wall is arranged to extend about the axis of the tubular element and form a helical passage for the yarn being withdrawn from the confined space. The slot may have a width that increases or remains constant from one end to the other end. This helical arrangement of the slot causes the yarn bundle withdrawn from the confined space through the slot to wrap around an outside portion of the cylindrical wall of the tubular element, with the extent of wrapping of the yarn about the cylindrical wall causing the tension applied to the yarn bundle to vary, i.e. the tension increases as the wrapping increases.

In yet another embodiment of the invention, the tubular element has a cylindrical wall which is provided with an elongated slot having one part or portion that is in the form of a helix and another part or portion that extends linearly parallel to the axis of the tubular element, with the width of the slot remaining constant or continuously increasing from one end to the other end.

In accordance with this invention, the yarn is pulled as a yarn bundle from the end of the compacted yarn mass or yarn plug in the confined space at an angle to the longitudinal axis of the tubular element. The cylindrical wall portion defining and surrounding the elongated slot or passage formed in the cylindrical wall of the tubular element serves to retain the remaining portion of the yarn mass within the confined space as the yarn bundle is formed. Moreover, the tension applied to the yarn bundle withdrawn from the confined space determines the rate of removal of the yarn by varying the density and configuration of the yarn bundle. For example, when the yarn bundle is pulled from the compacted yarn mass under a high tension, the filaments forming the yarn bundle are stretched out to form a relatively dense yarn. Under a low tension the filaments forming the yarn bundle remain in a crimped or bulked position to form a bulky yarn. Consequently, the amount of yarn removed from the compacted mass of yarn under high tension is less than the amount of yarn removed under low tension.

It will be understood that the inventory or amount of the compacted yarn mass retained in the confined space is, therefore, controlled by varying the tension applied to the yarn bundle.

Since the configuration of the elongated slot formed in the cylindrical wall portion of the tubular element is predetermined to apply a greater tension at one end of the tubular element than at the other, the position of the end of the compacted yarn mass within the tubular element, that is within the confined space, serves to control the tension applied to the yarn bundle as the yarn is being removed. The tension, in turn, controls the rate of yarn removal or withdrawal from the confined space. It will be appreciated that by appropriate selection of the configuration of the elongated slot, the dimensions of the tubular element as well as the winding or take-off rate of the yarn, the position of the yarn mass, particularly the end portion of the yarn mass, can be regulated to be retained within the confined space even though the input or delivery rate of the yarn mass to the yarn guide means is varied. This self-adjusting operation of the apparatus of the present invention is particularly effective for use with a constant yarn take-up device, such as a godet or winder, in that changes in the input or delivery of the compacted yarn mass to the confined space, that is into the tubular element, are compensated for or regulated automatically. That is, a change in the position for the end of compacted mass within the confined space will bring about a change in the tension applied to the yarn bundle and the rate of yarn removal.

Operation of the apparatus of this invention is as follows: a firm, round-shaped yarn plug or compacted yarn mass is formed by a yarn texturizing device such as disclosed in U.S. Pat. No. 3,983,610 and is pushed by a pneumatic fluid through a conduit into the apparatus of the present invention. The yarn plug is introduced or delivered into the confined space defined by the tubular element at the opening of the front end of the tubular element. At this time the yarn plug is moving at a speed of about 1/200th of the yarn speed into the yarn texturizing device, that is at a speed of 2.5 to 15 meters per minute. Although the yarn plug is being formed by introducing yarn into the yarn texturizing device at a substantially constant rate, there is a normal variation in the rate of plug build-up and, consequently, there is a variation in the input of the yarn plug into the confined space. The yarn plug enters the front open end of the tubular element and may exit from a rear open end of the tubular element. During start-up of the device, the end of the yarn is normally withdrawn from the yarn plug through the side of the tubular element via a portion of the elongated slot adjacent to the rear end of the tubular element. This rear end portion of the slot is usually provided with a width which will apply the lowest amount of tension of the yarn as it is being withdrawn from the yarn plug, e.g. from 5 to 10 grams. In one embodiment wherein the slot is entirely linear, the slot tapers to a width which is smaller near the inlet end of the tubular element so that the amount of yarn withdrawn via the slot is reduced by causing an increase in the tension applied to the yarn bundle, as the end of the yarn plug moves back to the front of the tubular element.

In another embodiment of the invention wherein a spiral or helical elongated slot is provided in the tubular element defining the yarn guide means, the yarn bundle is initially pulled outwardly from the side at the rear end of the tubular element and because of the helical configuration of the slot, the yarn bundle is caused to wrap immediately about the outside portion of the tubular element when the end of the plug or confined compacted yarn mass moves toward the forward end of the tubular element. Accordingly, there is an immediate increase in the tension applied to the yarn bundle. In the embodiment of the invention wherein the tubular element is provided with an elongated slot that has one portion that is a helical configuration and another portion that is linear and parallel to the longitudinal axis of the tubular element, the yarn bundle initially is pulled out from the side of the confined space at the rear end of the element through the linear portion of the slot. This arrangement allows the operator to stringup the apparatus and begin the take-up of the yarn at the lowest possible tension. There is no tension increase until the yarn plug moves back upstream toward the front end of the element and the yarn bundle is pulled through the helical portion of the slot and is caused to wrap about the outside of the tubular element.

In all embodiments, the change in position of the plug from the rear or downstream end to the front or upstream end of the tubular element causes an increase in the tension of the yarn bundle as it is being removed from the confined space and, consequently, reduces the amount of yarn being removed. The reduction in the rate of yarn removal then causes the end of the yarn plug to move forward in the tubular element and seek a position therein wherein the rate of input of the yarn plug is equal to the rate of yarn withdrawal as a yarn bundle. It will be appreciated that the apparatus of this invention enables an operator of a texturizing apparatus to vary the yarn input and/or the constant take-up over a relatively large range by using the same or different configuration of the elongated slot in a tubular element of the same or different length.

The apparatus and method of this invention will be further understood from the following detailed description and with reference to the accompanying drawings, wherein.

Figure 6:
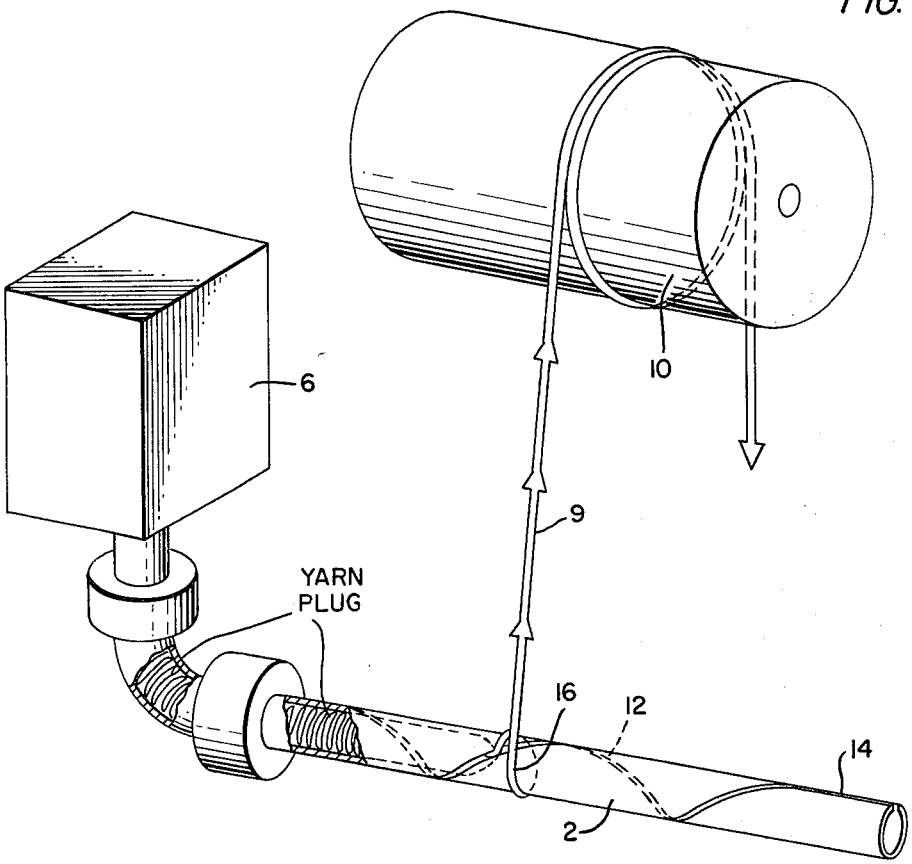
Figure 7:
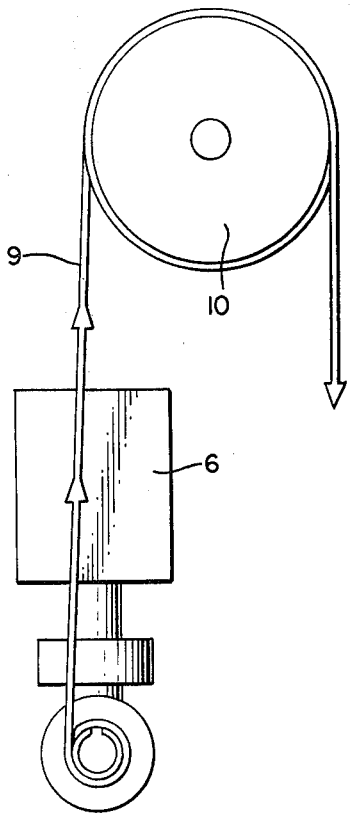

FIG. 6 is a perspective view of the arrangement of a plug forming device, a yarn take-up godet and a tubular element in accordance with the present invention, the tubular element having an elongated slot of a constant width with one portion of the slot arranged in a helix and another portion arranged linearly parallel to the longitudinal axis, with a wrap of yarn formed thereon; and FIG. 7 is an end view of the tubular element and godet shown in FIG. 6 on a smaller scale.

Figure 1:
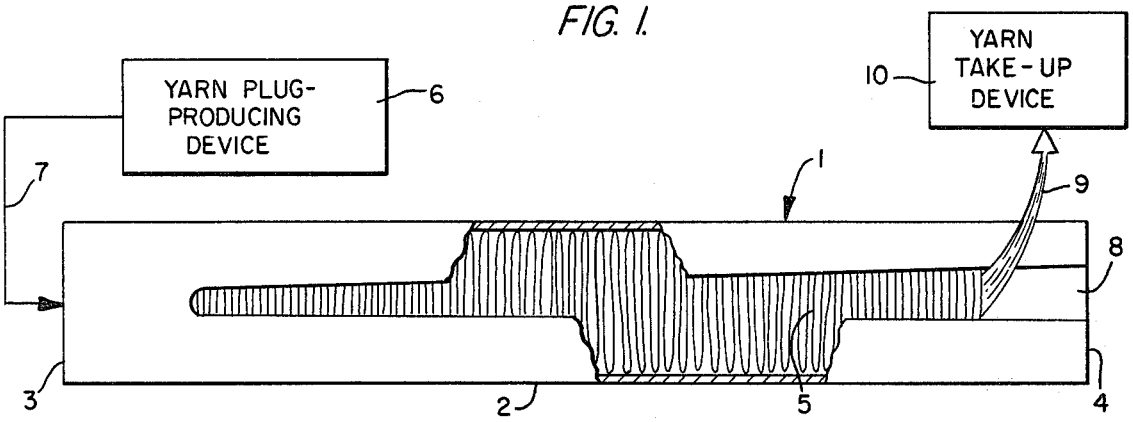
FIG. 1 is a side view showing the apparatus for controlling the tension on a yarn bundle withdrawn from a compacted yarn plug within a confined space and for maintaining an end portion of the yarn plug within the confined space used in conjunction with a yarn plug producing device and a yarn take-up device which are schematically illustrated; constant width from one end to the other.

In FIG. 1 reference numeral 1 generally designates the apparatus of the present invention for controlling the tension on a yarn bundle withdrawn from a mass of compacted yarn, that is a yarn plug, within a confined space. This apparatus includes a yarn guide means comprising a tubular element 2 having two open ends 3 and 4, respectively. End 3 defines an inlet opening for delivery or entry of a compacted yarn mass in the form of a plug 5. This compacted yarn mass is formed by a yarn plug-producing device schematically shown in the drawing and designated by reference numeral 6. The yarn plug is introduced into the opening at end 3 through a conduit 7 which is secured to the end 3 of the tubular element.

A slot designated by reference numeral 8 extends along a major proportion of the length of the tubular member and defines an outlet opening for withdrawing the yarn bundle 9 by a yarn take-up device 10 which includes a spindle or the like element for winding the yarn bundle into a yarn package. As shown the yarn bundle is pulled through slot 8 from the yarn plug at an angle of about 90° with respect to the longitudinal axis of the tubular element. It will be appreciated that this angle may vary from about 30°–90°, depending upon the location of the take-up device, and the take-up device may be located in such a manner that the yarn bundle withdrawn via the slot 8 will contact an outer portion of the tubular member. Generally, however, it is preferred that the yarn bundle be withdrawn directly through the slot 8 at such an angle as to avoid additional contact with the outside surface of the tubular member in this embodiment of the invention.

Slot 8, as illustrated, has a width that increases from that portion of the slot formed adjacent to end 3 to the other end of the slot which exits at end 4 of the tubular member. In one specific embodiment of this device, the dimensions of the slot will have a taper of from 0 to ¼ of an inch per foot, with a range of from 1/16 to 3/16 of an inch being preferred and the length of the slot will vary from 15 to 20 inches or more. In this regard it will be recognized that in this embodiment the length of the tubular member and the slot must be long enough to provide sufficient variation in the tension applied to the yarn bundle and to maintain a yarn having a variable input within the confined space.

It has been found that this embodiment of the apparatus runs particularly satisfactorily where space is not a limiting factor and where the variable input of the yarn plug is relatively low. However, when the variable input of the yarn plug is high with a limited amount of space, it has been found that this embodiment of the tubular element does not provide satisfactory results.

In general, the diameter of this tubular element as well as the tubular element shown in the other embodiments illustrated in the drawings must be from about ½ to 1¼ of an inch. The diameter of the tubular element, that is the inside diameter, is selected so that the diameter of the plug is from ⅛ to ¼ of an inch greater than the diameter of the plug to provide sufficient space around the plug for the plug to freely move backward and forward within the tubular element.

It should also be appreciated that the dimensions of the width of the slot must be maintained within a range of from about 1/16" to 5/32" to insure that the surrounding portion of the tubular element will maintain the plug downstream of the yarn withdrawal point in a relatively compact condition. Also this range of slot dimensions enables the take-up device to supply sufficient tension to the yarn bundle to pull the filaments together and to at least partially straighten out the filaments.

Figure 2:
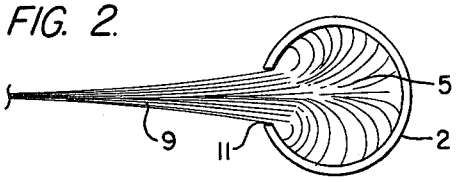

In general in this embodiment of the invention it is preferred to provide the slot with such dimensions and a length such that the forward end of the slot, that is near end 3 of the tubular element, will provide a tension from 30 to 50 grams to the yarn; whereas the rear end of the slot near end 4 of the tubular element will apply a tension of 5 to 50 grams. FIG. 2 illustrates the manner in which the yarn is taken from the tubular element through the slot 8, which has rounded edges 11 to prevent damaging of the yarn filaments.

Figure 3:
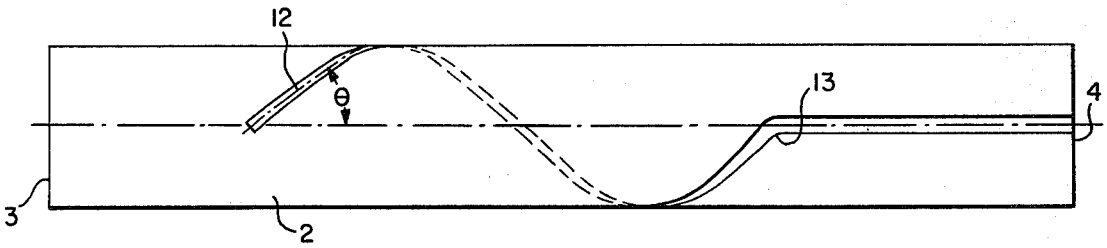

In the embodiment of the tubular element shown in FIG. 3, the tubular element 2 is provided with a slot 12 which is arranged in the form of a helix, with the helix having at least one lead or complete revolution about the longitudinal axis of the tubular element. Generally in this embodiment of the invention the width of the slot remains the same with a range of from 1/16 to 5/32 of an inch being particularly acceptable and with 3/32" being a preferred width. Moreover, the slot, i.e. the section of the slot having a helical configuration, may be provided with leads of from 2 to 14 inches long in increments of 1 inch. A particularly preferred lead length is 3 inches and usually one and in some cases two leads are provided in the tubular element. Thus it will be appreciated that where space is a factor a helical slot with a 3 inch lead is particularly preferred; whereas, when space is not a limiting factor, a helical slot with a 14 inch lead may be employed. It has been found that a tubular element having a lead of either 3 inch or 14 inches will provide satisfactory results. Accordingly the length of the tubular element may vary from about 5 inches to 20 inches in length. Also, the tension applied usually may be from 70–100 grams at the front end and 5 to 10 grams at the rear end of the slot.

As also shown in FIG. 3, the helical slot forms an angle $\theta$ with the longitudinal axis of the tubular element. It has been found that the angle $\theta$ should be within a range of from about 10° to 45°. At values below 10° the angle $\theta$ of the helical slot causes the length of the tubular element to become too great for practical applications. At values of the angle $\theta$ greater than 45°, the yarn bundle being pulled off of the yarn plug will not normally follow the helical slot. For the purposes of this invention, it is preferred that the angle $\theta$ is within the range of from 20° to 40°.

It will be observed from FIG. 3 that the helical portion of the slot 12 terminates at a zone designated by reference numeral 13 and that from this zone to the end 4 of the tubular element the slot continues in a linear fashion. The linear portion of the slot 15 provides a portion in the slot which has a substantially constant tension and, accordingly, provides a confined space in which the end of the yarn plug may move without causing any variation in the tension.

Figure 4:
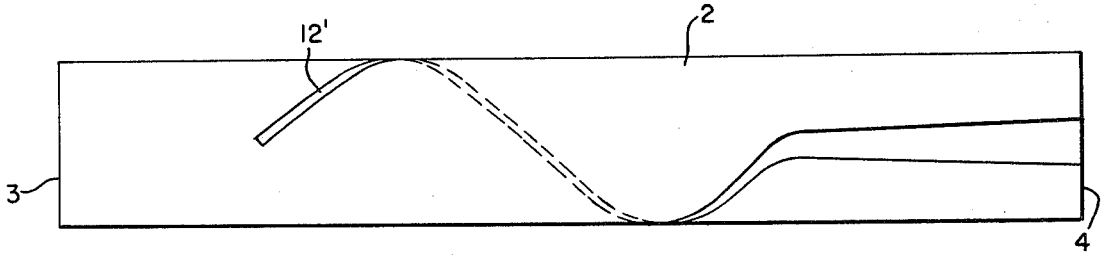
FIG. 4 shows yet another embodiment of the tubular element wherein the slot arranged in a helical configuration has a width which increases from one end to the other.

The tubular element shown in FIG. 4 is also provided with a helical slot designated by reference numeral 11'. This slot has a width that varies from the front end of 1/16 to 5/32 of an inch at the rear end, with a 1/16 of an inch front end and a ⅛ of an inch rear end being preferred. The finish on the outside and inside surfaces of the tubular element is from 4 to 63 RMS, with 16–32 RMS being preferred. It will be recognized that the finish of the surface must be selected to insure that the yarn is not damaged by rubbing over the surface and yet the surface must not be so smooth as to reduce the drag effect on the wrap of yarn which causes tension in the yarn.

Figure 5:
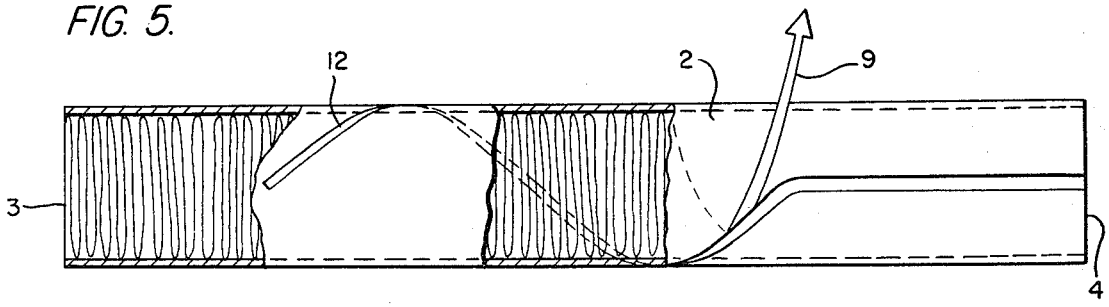
FIG. 5 is a side view of the tubular element shown in FIG. 3 with a plug being shown in phantom view within a portion of the confined space defined by the tubular element and a yarn bundle being withdrawn via the elongated slot formed within the tubular element.

FIG. 5 shows the relative position of a yarn plug within a tubular element of the type shown in FIG. 3 and the path of a yarn bundle 9 being withdrawn from the plug.

In FIG. 6 a tubular element 2 having two leads or complete revolutions of the helical slot is shown in a perspective view with the end of the yarn plug being near the front end of the slot so that a complete wrap 16 of the yarn is formed on the outside surface of the tubular element. This plug position provides a tension to the yarn that is approximately half of the maximum tension that will be provided by this tubular element. It will also be observed that the position of the yarn plug producing device 6 is also illustrated. This device is of the type described in U.S. Pat. No. 3,983,610. The yarn bundle is pulled from the tubular element by a take-up godet 10 which is operatively associated with a winding device for forming a yarn package. In the arrangement of the tubular element shown, it will also be seen that the linear portion 14 on the slot is positioned to be directed toward, i.e. to face, the take-up godet. Generally, the longitudinal axis of the tubular element and the longitudinal axis of the godet are arranged parallel or at an angle of not more than about 20° and in the same plane. Also the linear portion of the slot as well as the end portion of the helical portion is positioned directly below the outermost edge portion of the godet as further illustrated in FIG. 7. The take-up godet is usually spaced from the tubular element by a distance of from 1 to 5 feet to allow the yarn bundle to be pulled from the slot at an angle of from about 30°–90° to the longitudinal axis of the tubular element. It will be recognized that in this embodiment and all embodiments wherein the yarn bundle is guided through a slot having a helical configuration, the yarn bundle is pulled from the end of yarn plug at an angle of approximately 90° with respect to longitudinal axis of the plug, the yarn then wrapping about a portion of the outer circumference of the tubular element before being pulled out of contact with the tubular element.

What is claimed is:

1. An apparatus for controlling the tension on yarn withdrawn from a mass of compacted yarn within a confined space which comprises a yarn guide means having a tubular cylindrical wall portion defining a confined space for guiding and for accumulating a compacted mass of yarn therein, an inlet opening for entry of the compacted mass of yarn into one end of the confined space and an outlet opening for allowing withdrawal of the yarn in the form of a yarn bundle from the confined space; said outlet opening being an elongated slot that is provided in the cylindrical wall portion of the yarn guide means and that applies tension to the yarn bundle being withdrawn from the confined space, said slot having a preselected configuration so that the slot provides means for varying the tension applied to the yarn bundle and for varying the density of the yarn bundle as the yarn mass moves from one end of the confined space to the other end.

2. An apparatus according to claim 1 wherein said yarn guide means is a tubular element having a cylindrical wall which defines the confined space and that includes said elongated slot, said elongated slot extending along the longitudinal axis of the confined space.

3. An apparatus for controlling the tension on yarn withdrawn from a mass of compacted yarn within a confined space which comprises a tubular element having a cylindrical wall defining a confined space for guiding and for accumulating a compacted mass of yarn therein, an inlet opening for entry of the compacted mass of yarn into one end of the confined space and an outlet opening for allowing withdrawal of the yarn in the form of a yarn bundle from the confined space; said outlet opening being an elongated slot that is provided in the cylindrical wall of the tubular element, that extends along the longitudinal axis of the confined space and that applies tension to the yarn bundle being withdrawn from the confined space; said slot having a preselected configuration so that the slot provides means for varying the tension applied to the yarn bundle as the yarn mass moves from one end of the confined space to the other end, said slot being arranged to extend parallel to the longitudinal axis of the tubular element, and said slot having a width that increases continuously from one end to the other end of the slot in order to decrease the amount of tension applied to the yarn bundle along the length of the slot.

4. An apparatus for controlling the tension on yarn withdrawn from a mass of compacted yarn within a confined space which comprises a tubular element having a cylindrical wall defining a confined space for guiding and accumulating a compacted mass of yarn therein, an inlet opening for entry of the compacted mass of yarn into one end of the confined space and an outlet opening for allowing withdrawal of the yarn in the form of a yarn bundle from the confined space; said outlet opening being an elongated slot that is provided in the cylinrical wall of the tubular element, that extends along the longitudinal axis of the confined space and that applies tension to the yarn bundle being withdrawn from the confined space; said slot having a predetermined configuration so that the slot provides means for varying the tension applied to the yarn bundle as the yarn mass moves from one end of the confined space to the other end, and said slot being also arranged to extend about the longitudinal axis of the tubular element and to form a helical passage within the cylindrical wall for the yarn bundle being withdrawn from the confined space.

5. An apparatus according to claim 4 wherein the slot has a width that increases from one end to the other end of the slot.

6. An apparatus according to claim 4 wherein the slot has a width that remains constant from one end to the other end of the slot.

7. An apparatus for controlling the tension on yarn withdrawn from a mass of compacted yarn within a confined space which comprises a tubular element having a cylindrical wall defining a confined space for guiding and accumulating a compacted mass of yarn therein, an inlet opening for entry of the compacted mass of yarn into one end of the confined space and an outlet opening for allowing withdrawal of the yarn in the form of a yarn bundle from the confined space; said outlet opening being an elongated slot that is provided in the cylindrical wall of the tubular element, that extends along the longitudinal axis of the confined space and that applies tension to the yarn bundle being withdrawn from the confined space; said slot having a predetermined configuration so that the slot provides means for varying the tension applied to the yarn bundle as the yarn mass moves from one end of the confined space to the other end, and said elongated slot having one portion that is in the form of a helix and another portion that is linear and parallel to the longitudinal axis of said tubular element.

8. An apparatus according to claim 7 wherein the linear portion extends for a distance of from about 1 to 5 inches along said cylindrical wall.

9. An apparatus according to claim 7 wherein the helical portion of the slot has at least one revolution about the longitudinal axis of the tubular element.

10. Apparatus according to claim 7 wherein the helical portion of the slot forms an angle with the longitudinal axis of the tubular element of from 10° to 45°.

11. An apparatus according to claim 2 further comprising means for producing the compacted mass of yarn and for introducing the compacted mass of yarn into the confined space and yarn take-up means for withdrawing the yarn bundle from the confined space, said yarn take-up means being positioned at a fixed location with respect to said tubular element.

12. An apparatus according to claim 2 wherein configuration of the slot causes the tension applied to the yarn bundle to decrease continuously as the yarn mass moves from one end of the confined space to the other.

13. An apparatus according to claim 4 wherein a yarn take-up means is positioned with respect to the tubular element so that movement of the end portion of the compacted yarn mass towards the inlet opening of the tubular element causes the yarn bundle to wrap around the outside portion of the tubular element.

14. An apparatus according to claim 7 wherein a yarn take-up means includes a godet roller that is arranged so that the linear portion of the slot is directed towards the roller.

15. A method for varying the tension applied to a yarn bundle withdrawn from a yarn mass retained within a confined space which comprises introducing a compacted yarn mass into a confined space, said confined space being defined by a tubular element having a cylindrical wall portion and an elongated slot provided in said cylindrical wall portion, withdrawing a yarn bundle from the end of the yarn mass retained within the confined space through the elongated slot, applying tension to the yarn bundle being withdrawn from the confined space by providing the slot with a width which retains the yarn mass within the confined space and varying the tension applied to the yarn bundle and thereby varying the density of the yarn bundle as the end of the yarn mass moves from one end to the other end of the confined space.

16. The method of claim 15 wherein the tension applied to the yarn bundle is varied by arranging the slot to extend parallel to the longitudinal axis of the cylindrical wall portion and by providing the slot with a width that increases from one end to the other end of the slot.

17. A method for varying the tension applied to a yarn bundle withdrawn from a yarn mass retained within a confined space which comprises introducing a compacted yarn mass into a confined space, said confined space being defined by a tubular element having a cylindrical wall portion and an elongated slot provided in said cylindrical wall portion, withdrawing a yarn bundle from the end of the yarn mass contained within the confined space through the elongated slot, applying tension to the yarn bundle being withdrawn from the confined space by providing the slot with a width which retains the yarn mass within the confined space and varying the tension applied to the yarn bundle as the end of the yarn mass moves from one end to the other end of the confined space, the tension applied to the yarn bundle being varied by arranging the slot in the form of a helical passage within the cylindrical wall portion and by causing the yarn bundle withdrawn through the helical passage to wrap around an outside portion of the cylinrical wall portion.

18. A method for varying the tension applied to the yarn bundle withdrawn from a yarn mass retained within a confined space which comprises introducing a compacted yarn mass into a confined space, said confined space being defined by a tubular element having a cylindrical wall portion and an elongated slot provided in said cylindrical wall portion, withdrawing a yarn bundle from the end of the yarn mass retained within the confined space through the elongated slot, applying tension to the yarn bundle being withdrawn from the confined space by providing the slot with a width which retains the yarn mass within the confined space and varying the tension applied to the yarn bundle as the end of the yarn mass moves from one end to the other of the confined space, the tension applied to the yarn bundle being varied by arranging a front portion of the slot to be in the form of a helix and a rear portion of the slot to be linear and parallel to the longitudinal axis of the tubular element, and by causing the yarn bundle to be withdrawn initially through the linear portion and then through the helical portion, the yarn bundle wrapping around the outside portion of the cylindrical wall portion after the yarn bundle exits through the helical portion.

19. The method of claim 15, wherein the tension applied to the yarn bundle is varied by withdrawing the yarn bundle through a helical passage formed by the elongated slot within the cylindrical wall portion and by causing the yarn bundle withdrawn through the helical passage to wrap around an outside portion of the cylindrical wall portion.

20. The method of claim 15, wherein the tension applied to the yarn bundle is varied by withdrawing the yarn bundle from a linear portion of the elongated slot that extends parallel to a longitudinal axis of the cylindrical wall portion and that has a width that increases from one end to the other end of the slot.

21. The method of claim 15, wherein the tension applied to the yarn bundle is varied by withdrawing the yarn bundle through a portion of the elongated slot that is in the form of a helix and by causing the yarn bundle to wrap around an outside portion of the cylindrical wall portion after the yarn bundle exits through the helical portion of the slot.

22. An apparatus according to claim 1, wherein said slot is arranged to extend parallel to a longitudinal axis of said tubular element, said slot having a width that increases continuously from one end to the other end of the slot in order to decrease the amount of tension applied to the yarn bundle along the length of the slot and to increase the amount of yarn in the form of the yarn bundle withdrawn from said slot.

23. An apparatus according to claim 1, wherein the slot in the cylindrical wall portion is arranged to extend about the longitudinal axis of the tubular cylindrical wall and to form a helical passage within the cylindrical wall portion for the yarn bundle being withdrawn from the confined space.

24. An apparatus according to claim 23, wherein the slot has a width that increases from one end to the other end of the slot.

25. An apparatus according to claim 24, wherein the slot has a width that remains constant from one end to the other end of the slot.

26. An apparatus according to claim 1, wherein said elongated slot has one portion that is in the form of a helix and another portion that is linear and parallel to a longitudinal axis of said tubular cylindrical wall portion.

27. An apparatus according to claim 26, wherein the linear portion extends for a distance of about 1 to 5 inches along said cylindrical wall portion.

28. An apparatus according to claim 26, wherein the helical portion of the slot has at least one revolution about the longitudinal axis of the cylindrical wall portion.

29. An apparatus according to claim 26, wherein the helical portion of the slot forms an angle with the longitudinal axis of the cylindrical wall portion of from 10° to 45°.

30. An apparatus for controlling the tension on yarn withdrawn from a mass of compacted yarn within a confined space which comprises a tubular element having a cylindrical wall portion defining a confined space for guiding and for accumulating a compacted mass of yarn therein, an inlet opening for entry of the compacted mass of yarn into one end of the confined space and an outlet opening for allowing withdrawal of the yarn in the form of a yarn bundle from the confined space; said outlet opening being an elongated slot that is provided in the cylindrical wall portion of the tubular element, that extends along a portion of the length of the tubular element and that applies tension to the yarn bundle being withdrawn from the confined space; said slot having such a preselected configuration that the slot provides means for varying the tension applied to the yarn bundle and for varying the density of the yarn bundle as the yarn mass moves in said confined space along the slot.

31. A method for varying the tension applied to a yarn bundle withdrawn from a yarn mass retained within a confined space which comprises introducing a compacted yarn mass into a confined space, said confined space being defined by a tubular element having a cylindrical wall portion and an elongated slot provided in said cylindrical wall portion, withdrawing a yarn bundle from the end of the yarn mass retained within the confined space through the elongated slot, applying tension to the yarn bundle being withdrawn from the confined space by providing the slot with a width which retains the yarn mass within the confined space and varying the tension applied to the yarn bundle and thereby varying the density of the yarn bundle as the end of the yarn mass moves in said confined space along said elongated slot.

* * * * *